US010328490B2

(12) United States Patent
Durocher et al.

(10) Patent No.: US 10,328,490 B2
(45) Date of Patent: Jun. 25, 2019

(54) TURBINE SHROUD SEGMENT WITH INTER-SEGMENT OVERLAP

(71) Applicant: Pratt & Whitney Canada Corp., Longueuil (CA)

(72) Inventors: Eric Durocher, Vercheres (CA); Guy Lefebvre, Saint-Bruno (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 337 days.

(21) Appl. No.: 14/737,563

(22) Filed: Jun. 12, 2015

(65) Prior Publication Data

US 2015/0273585 A1 Oct. 1, 2015

Related U.S. Application Data

(63) Continuation of application No. 13/222,028, filed on Aug. 31, 2011, now Pat. No. 9,079,245.

(51) Int. Cl.

| | |
|---|---|
| ***B22F 3/00*** | (2006.01) |
| ***B22F 3/12*** | (2006.01) |
| ***B22F 3/22*** | (2006.01) |
| ***B22F 5/00*** | (2006.01) |
| ***B22F 7/06*** | (2006.01) |
| ***F01D 9/02*** | (2006.01) |
| ***C22C 19/03*** | (2006.01) |
| ***C22C 19/07*** | (2006.01) |
| ***F01D 11/08*** | (2006.01) |
| ***F01D 25/24*** | (2006.01) |

(52) U.S. Cl.

CPC ..... *B22F 5/009* (2013.01); *B22F 3/004* (2013.01); *B22F 3/12* (2013.01); *B22F 7/06* (2013.01); *C22C 19/03* (2013.01); *C22C 19/07* (2013.01); *F01D 9/02* (2013.01); *F01D 11/08* (2013.01); *F01D 25/24* (2013.01); *B22F 3/225* (2013.01); *F05D 2230/30* (2013.01); *F05D 2240/11* (2013.01)

(58) Field of Classification Search

CPC ..... F01D 25/26; F01D 25/28
USPC ..... 415/139
See application file for complete search history.

(56) References Cited

U.S. PATENT DOCUMENTS

| | | | |
|---|---|---|---|
| 3,831,258 | A | 8/1974 | Elbert et al. |
| 4,137,619 | A | 2/1979 | Beltran et al. |
| 4,383,854 | A | 5/1983 | Dembowski et al. |
| 4,604,780 | A | 8/1986 | Metcalfe |
| 4,871,621 | A | 10/1989 | Bagley et al. |
| 5,010,050 | A | 4/1991 | Wullenweber et al. |
| 5,130,084 | A | 7/1992 | Matheny et al. |
| 5,320,487 | A | 6/1994 | Walker et al. |

(Continued)

*Primary Examiner* — Justin D Seabe
*Assistant Examiner* — Jason Mikus
(74) *Attorney, Agent, or Firm* — Norton Rose Fulbright Canada L.L.P.

(57) ABSTRACT

A method of manufacturing a turbine shroud segment for a gas turbine engine comprises: metal injection molding (MIM) a shroud segment body with a groove defined in a first lateral side thereof and with a flow restrictor projecting integrally from an opposite second lateral side thereof. The groove is oversized relative to the flow restrictor to provide for a clearance fit between the flow restrictor and the groove of adjacent turbine shroud segments when assembled together in a ring formation. The shroud segment body with the integrated flow restrictor are then subjected to debinding and sintering operations.

5 Claims, 3 Drawing Sheets

(56) References Cited

U.S. PATENT DOCUMENTS

| | | | |
|---|---|---|---|
| 5,553,999 | A | 9/1996 | Proctor et al. |
| 5,574,957 | A | 11/1996 | Barnard et al. |
| 5,762,472 | A | 6/1998 | Pizzi et al. |
| 5,772,748 | A | 6/1998 | Hubbard |
| 5,933,699 | A | 8/1999 | Ritter et al. |
| 6,102,656 | A | 8/2000 | Nissley et al. |
| 6,217,282 | B1 | 4/2001 | Stanka |
| 6,241,467 | B1 | 6/2001 | Zelesky et al. |
| 6,254,333 | B1 | 7/2001 | Merry |
| 6,350,404 | B1 | 2/2002 | Li et al. |
| 6,425,738 | B1 | 7/2002 | Shaw |
| 6,439,844 | B1 | 8/2002 | Turnquist et al. |
| 6,679,680 | B2 | 1/2004 | Um et al. |
| 6,709,771 | B2 | 3/2004 | Allister |
| 6,857,848 | B2 | 2/2005 | Fokine et al. |
| 6,874,562 | B2 | 4/2005 | Knott et al. |
| 6,910,854 | B2 | 6/2005 | Joslin |
| 7,029,228 | B2 | 4/2006 | Chan et al. |
| 7,052,241 | B2 | 5/2006 | Decker |
| 7,114,920 | B2 | 10/2006 | Synnott |
| 7,128,522 | B2 | 10/2006 | Jutras |
| 7,175,387 | B2 | 2/2007 | Kreis et al. |
| 7,217,081 | B2 | 5/2007 | Scheurlen et al. |
| 7,234,920 | B2 | 6/2007 | Imbourg et al. |
| 7,407,622 | B2 | 8/2008 | Voice et al. |
| 7,687,021 | B2 | 3/2010 | Imbourg et al. |
| 7,857,581 | B2 | 12/2010 | Mons et al. |
| 7,875,340 | B2 | 1/2011 | Cho et al. |
| 2005/0214156 | A1 | 9/2005 | Troitski et al. |
| 2009/0148277 | A1* | 6/2009 | Tholen ..... F01D 11/025 415/173.1 |
| 2009/0185899 | A1 | 7/2009 | Bouchard et al. |
| 2010/0187762 | A1 | 7/2010 | Heinz-Schwarzmaier |
| 2010/0232940 | A1* | 9/2010 | Ammann ..... F01D 9/04 415/173.1 |
| 2010/0247298 | A1* | 9/2010 | Nakamura ..... F01D 11/18 415/173.1 |
| 2011/0033331 | A1 | 2/2011 | Tuppen et al. |
| 2012/0073303 | A1* | 3/2012 | McCarren ..... F23M 5/02 60/752 |
| 2012/0186768 | A1 | 7/2012 | Sun et al. |

* cited by examiner

TURBINE SHROUD SEGMENT WITH INTER-SEGMENT OVERLAP

RELATED APPLICATIONS

The present application is a continuation of U.S. Pat. No. 9,079,245 issued on Jul. 15, 2015, the content of which is incorporated herein by reference.

TECHNICAL FIELD

The application relates generally to the field of gas turbine engines, and more particularly, to turbine shroud segments.

BACKGROUND OF THE ART

Gas turbine engines are operated at extremely high temperatures for the purpose of maximizing engine efficiency. Components of a gas turbine engine, such as turbine shroud segments and their supporting structures, are thus exposed to extremely high temperatures. The shroud is constructed to withstand primary gas flow temperatures, but its supporting structures are not and must be protected therefrom. Therefore, it is desirable to prevent the shroud supporting structure from being directly exposed to heat radiations from the hot gaspath. It is also desirable to achieve the required cooling of the turbine shroud segments and surrounding structure with the minimum use of coolant so as to minimize the negative effect on the overall engine efficiency.

There is thus a need to provide an improved turbine shroud arrangement which addresses theses and other limitations of the prior art.

SUMMARY

In one aspect, there is provided a turbine shroud assembly of a gas turbine engine, comprising a plurality of shroud segments disposed circumferentially one adjacent to another, wherein circumferentially adjacent shroud segments have confronting sides defining an inter-segment gap therebetween, and wherein a flow restrictor integrally projects from a first one of said confronting sides of a first shroud segment through the inter-segment gap and into overlapping relationship with a cooperating joint surface provided at a second one of said confronting sides of an adjacent second shroud segment, said flow restrictor and said joint surface defining a clearance therebetween configured to accommodate thermal expansion during hot operating conditions, said clearance and said inter-segment gap being configured to cooperatively define a tortuous leakage path in a generally radial direction between said first and second shroud segments at said hot operating conditions.

In a second aspect, there is provided a turbine shroud assembly of a gas turbine engine, comprising a plurality of shroud segments disposed circumferentially one adjacent to another, each of the shroud segment having a metal injection molded body (MIM) being axially defined from a leading edge to a trailing edge in a direction from an upstream position to a downstream position of a hot gas flow passing through the turbine shroud assembly, and being circumferentially defined between opposite first and second lateral sides, said MIM shroud body including a platform having a hot gas path side surface and a back side surface, and forward and aft arms extending from the back side surface of the platform, said forward and aft arms being axially spaced-apart from each other, said MIM shroud body of each of said shroud segments further comprising an integral flow restrictor projecting from said second lateral side through an inter-segment gap defined between confronting first and second lateral sides of adjacent shroud segments, each of said shroud segments having a groove defined in said first lateral side for receiving the flow restrictor of an adjacent shroud segment, the groove being oversized relative to the flow restrictor to provide for the presence of a clearance between the groove and the flow restrictor, the clearance defining a tortuous leakage path between adjacent shroud segments.

In a third aspect, there is provided a method of manufacturing a turbine shroud segment for a gas turbine engine, the method comprising: forming a shroud segment body with a groove defined in a first lateral side thereof and with a flow restrictor projecting integrally from an opposite second lateral side thereof, the groove being oversized relative to the flow restrictor to provide for a clearance fit between the flow restrictor and the groove of adjacent turbine shroud segment when assembled together in a ring formation, and wherein the step of forming comprises metal injection molding (MIM) the flow restrictor together with the shroud segment body, and then subjecting the turbine shroud segment body with the integrated flow restrictor to debinding and sintering operations.

DESCRIPTION OF THE DRAWINGS

Reference is now made to the accompanying figures, in which.

DETAILED DESCRIPTION

Figure 1:
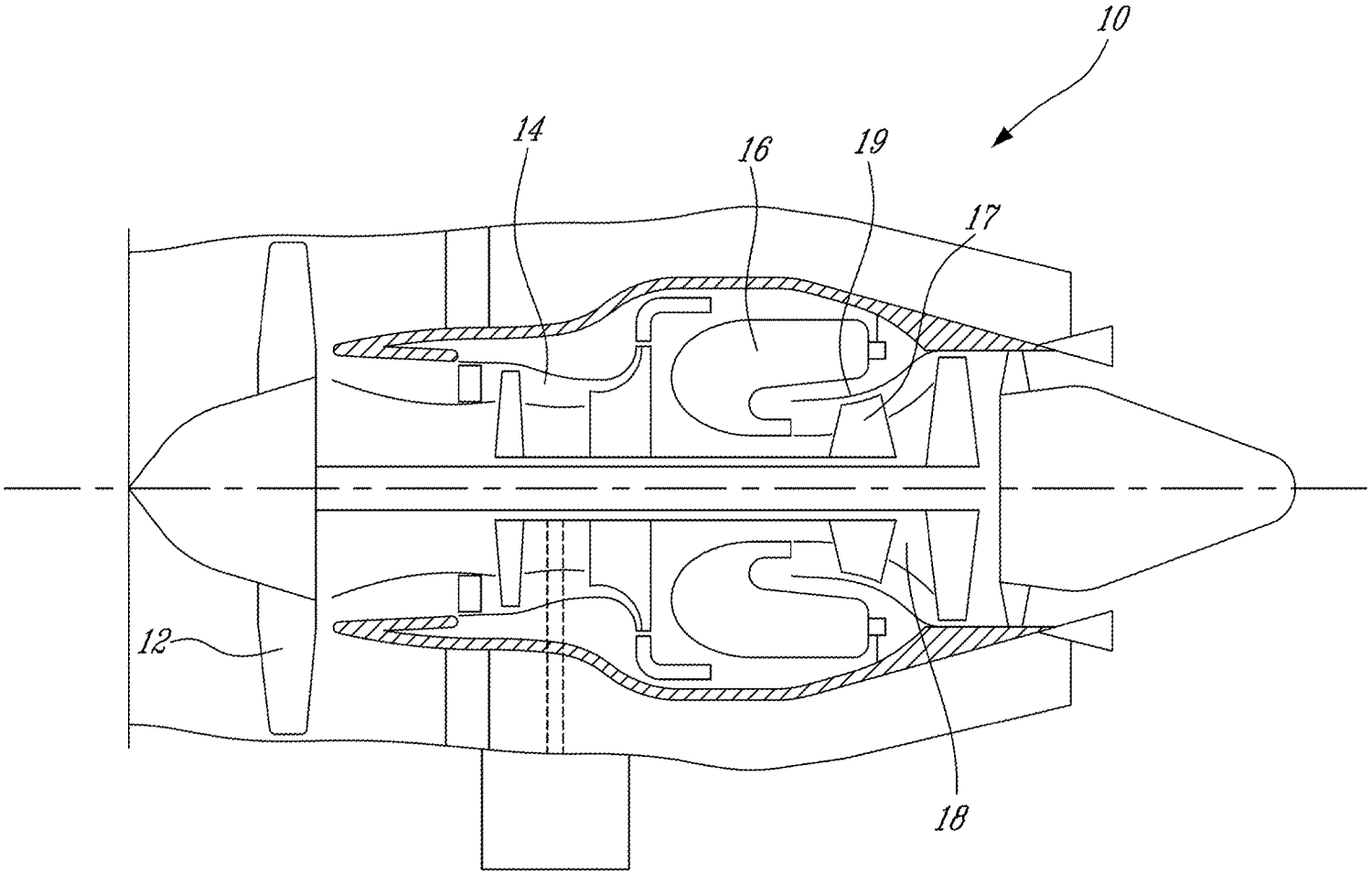
FIG. 1 is a schematic cross-section view of a gas turbine engine.

FIG. 1 illustrates a gas turbine engine 10 of a type preferably provided for use in subsonic flight, generally comprising in serial flow communication a fan 12 through which ambient air is propelled, a multistage compressor 14 for pressurizing the air, a combustor 16 in which the compressed air is mixed with fuel and ignited for generating an annular stream of hot combustion gases, and a turbine section 18 for extracting energy from the combustion gases.

Figure 2:
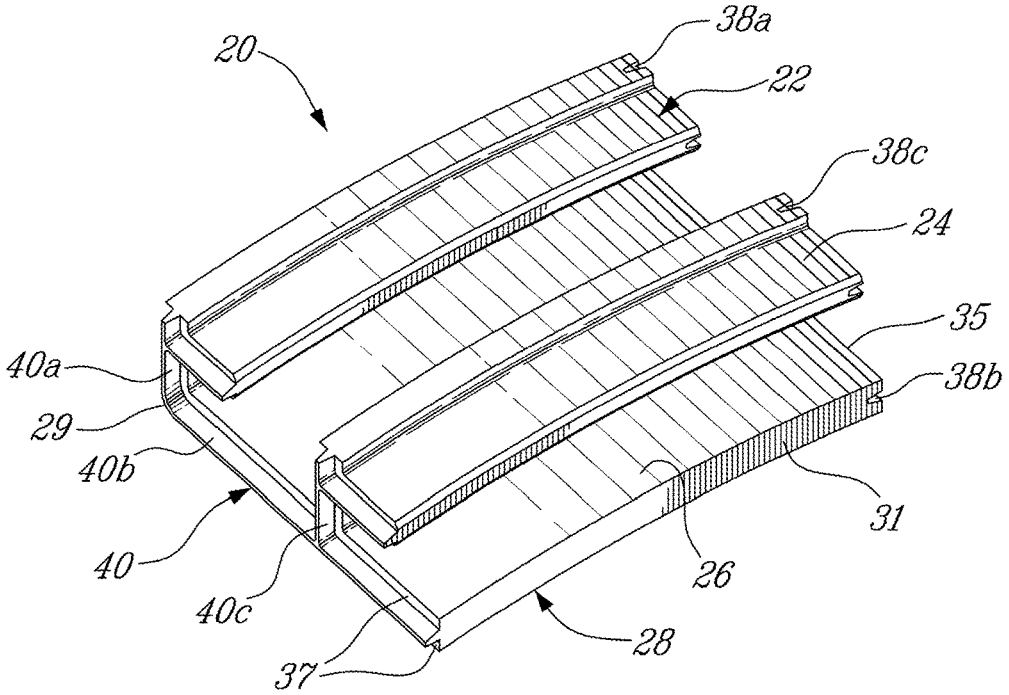
FIG. 2 is an isometric view of a turbine shroud segment which may be metal injection molded (MIM) with an integral inter-segment flow restrictor.
Figure 3:
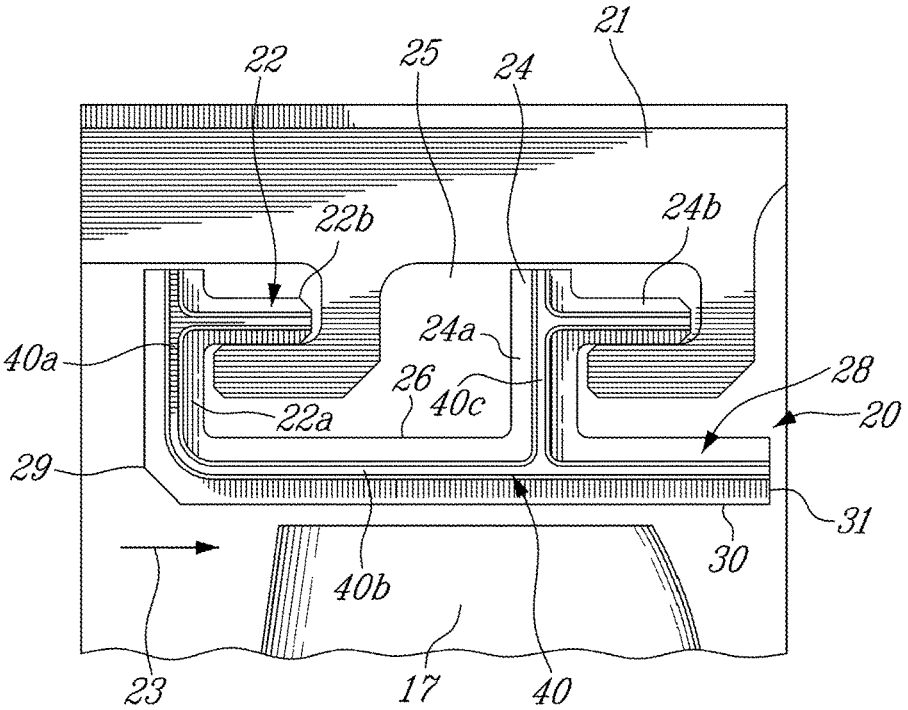
FIG. 3 is an axial cross-section view illustrating a turbine shroud segment mounted to a turbine support case about a turbine rotor including a circumferential array of turbine blades.

The turbine section 18 generally comprises one or more stages of rotor blades 17 extending radially outwardly from respective rotor disks, with the blade tips being disposed closely adjacent to an annular turbine shroud 19 supported from a turbine shroud support 21 (FIG. 3). The turbine shroud 19 includes a plurality of shroud segments disposed circumferentially one adjacent to another to jointly form an outer radial gaspath boundary for the hot combustion gases flowing through the stage of rotor blades 17. FIG. 2 illustrates an example of one such turbine shroud segments 20.

Referring concurrently to FIGS. 2 and 3, it can be appreciated that the shroud segment 20 extends axially from a leading edge 29 to a trailing edge 31 in a direction from an upstream position to a downstream position of a hot gas flow (see arrow 23 in FIG. 3) passing through the turbine shroud 19, and circumferentially between opposite first and second lateral sides 35, 37. The shroud segment 20 has axially spaced-apart forward and aft arms which can be provided in the form of hooks 22 and 24 extending radially outwardly from a back side or cold radially outer surface 26 of an arcuate platform 28. The hooks 22 and 24 each have a radially extending leg portion 22*a*, 24*a* and an axially extending flange mounting portion 22*b*, 24*b* for engagement with a corresponding hook structure of the turbine shroud support 21, which may be provided in the form of a shroud hanger as shown in FIG. 3. The radially extending leg portions 22*a* and 24*a* define therebetween a cavity 25 which is in fluid flow communication with a source of coolant under pressure (e.g. bleed air from the compressor 14). The platform 28 has a radially inner hot gas flow surface 30 adapted to be disposed adjacent to the tip of the turbine blades 17. Cooling passages (not shown) are typically defined in the platform 28 for receiving cooling air under pressure from the cavity 25 between the forward and aft hooks 22 and 24.

Figure 4:
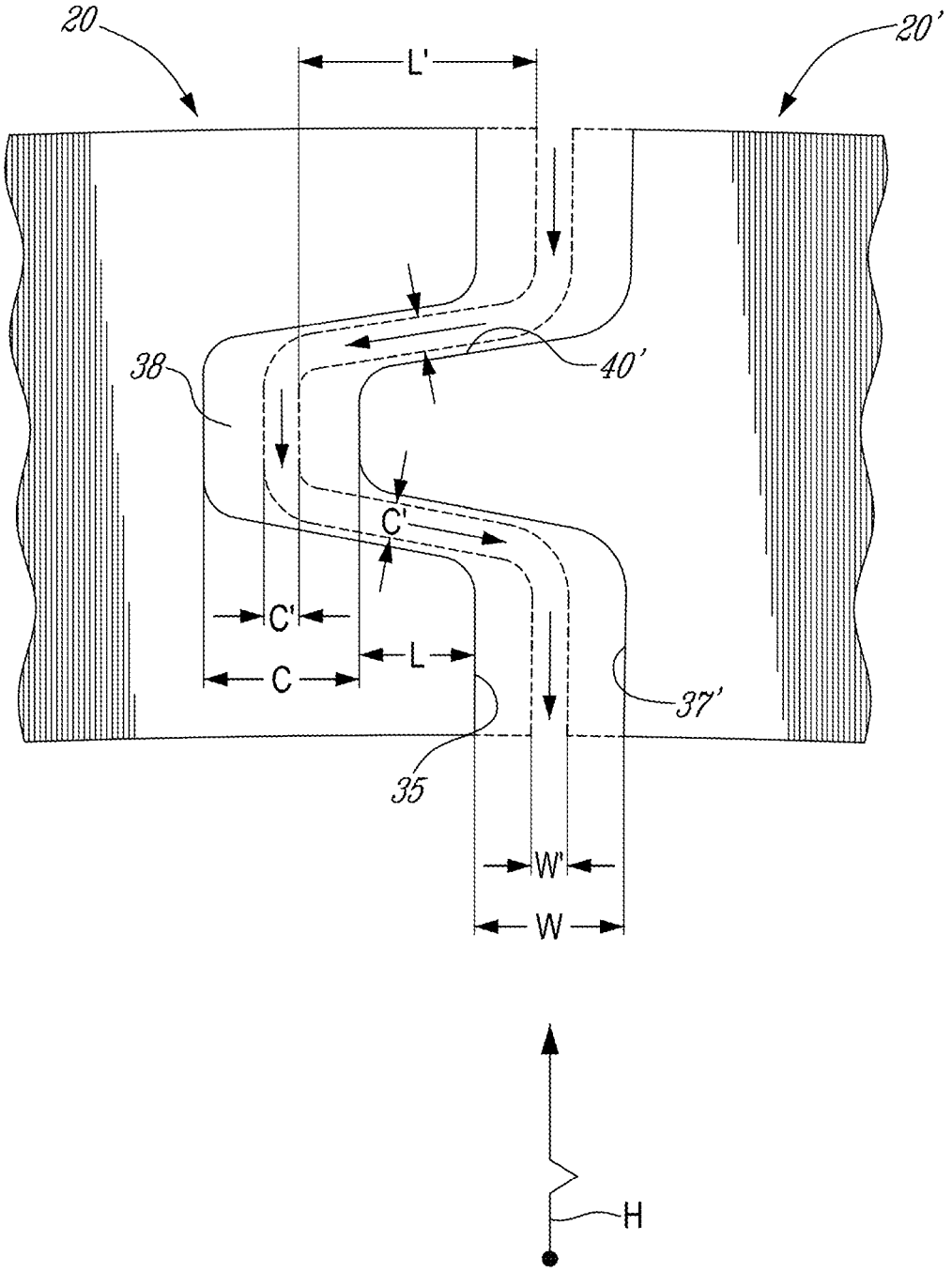
FIG. 4 is an enlarged cross-section view illustrating an overlap interface between two circumferentially adjacent shroud segments in cold assembly and hot operating conditions.

It is desirable to protect the turbine shroud support 21 and the other surrounding turbine structures from the high temperatures of the gas flow 23 flowing through the turbine shroud 19. It is also desirable to minimize coolant consumption. To that end, it is herein proposed to provide an inter-segment overlap between circumferentially adjacent shroud segments 20. An example of one such inter-segment overlap is shown in FIG. 4. As will be seen hereinafter, the overlap interface at the confronting side faces of each pair of adjacent shroud segments prevents the shroud support structure 21 from being directly exposed to heat radiations from the hot gaspath, while at the same time restricting coolant leakage through the inter-segment gaps, which is advantageous from an engine performance point of view.

Referring back to FIGS. 2 and 3, the overlap interface between adjacent shroud segments 20 may be provided by forming each shroud segment 20 with a groove 38 in the first lateral side 35 thereof and with a complementary tongue or flow restrictor 40 on its opposite second lateral side 37. In the embodiment shown in FIGS. 2 and 3, the groove 38 and the flow restrictor 40 have both axial and radial components. More particularly, the flow restrictor 40 has a forward leg portion 40*a* projecting from the forward hook 22, an axially extending base portion 40*b* projecting from the platform 28, and an aft leg portion 40*c* projecting from the aft hook 24. The groove 38 has corresponding forward and aft leg portions 38*a* and 38*c* and an axially extending base portion 38*b* respectively defined in the forward and aft hooks 22 and 24 and in the platform 28. In the illustrated embodiment, the forward and aft leg portions 40*a* and 40*c* of the flow restrictor 40 and associated groove 38 both have a radially outer axially extending component defined on the flanges 22*b* and 24*b* of the forward and aft hooks 22 and 24. However, it is understood that the flow restrictor 40 and the groove 38 could adopt various other configurations. For instance, they could be provided on the platform 28 only. According to another non-illustrated embodiment, the flow restrictor 40 and the groove 38 could have a U-shaped configuration corresponding to the forward and aft hooks 22 and 24 and the portion of the platform 28 extending between the forward and aft hooks 22 and 24.

FIG. 4 illustrates an example of an inter-segment gap W between the first lateral side 35 of a first shroud segment 20 and the opposed facing second lateral side 37' of a second adjacent shroud segment 20' at a cold assembly condition (i.e. room temperature). The stippled lines in FIG. 4 illustrate the inter-segment gap W' at a representative hot engine operating condition.

It can be appreciated from FIG. 4, that the flow restrictor 40' of shroud segment 20' projects through the inter-segment gap W and partly into the opposed facing groove 38 of shroud segment 20 so as to provide an overlap L between the adjacent segments 20 and 20'. It can also be appreciated that the groove 38 is oversized relative to the flow restrictor 40' to provide a clearance fit therebetween. More particularly, the groove 38 and the flow restrictor 40' are sized to provide a clearance C at the cold assembly condition. The clearance C is selected to ensure that a clearance C' will remain under hot operating conditions. For illustration purposes, during hot operation conditions, the clearance C' and the inter-segment gap W' may be of about 0.005 inches and the overlap L' between the segments 20 and 20' may be of about 0.05 inches. During engine operation, the clearance C' and the inter-segment gap W' define a tortuous path which will prevent the shroud support structure 21 from being directly exposed to hot radiations H from the gaspath while allowing a controlled or restricted amount of coolant to flow over the lateral side edges of the shroud segments to properly cool same and avoid hot spots to occur thereat.

In the embodiment shown in FIG. 4, the groove 38 and the flow restrictor 40' have corresponding tapering cross-sectional profiles. The flow restrictor 40' tapers in a direction away from the lateral side 37' of the shroud segment 20'. The groove 38 tapers in a depthwise direction.

By so overlapping the adjacent shroud segments, it is also possible for a given shroud segment to provide support to an adjacent damaged shroud segment. Indeed, the flow restrictor 40 may be provided in the form of a rigid tongue integrally projecting from one lateral side of each shroud segments, thereby offering a strong arresting surface against which a damaged segment may rest. The overlap joint between the segments may thus also be used to prevent unacceptable deflection and/or collapsing at the shroud segment sides when exposed to excessive temperatures. This contributes to maintaining tip clearance integrity and, thus, engine performances.

The shroud segment overlap design may be implemented by using a metal injection molding (MIM) processes. By metal injection molding the flow restrictor together with the body of the shroud segment, the flow restrictor may be incorporated in the shroud segment design at virtually no extra cost and without additional manufacturing operations. That would not be possible with a conventional casting process. The manufacturing process of an exemplary turbine shroud segment may be described as follows. First, an injection mold (not shown) having a plurality of mold details adapted to be assembled together to define a mold cavity having a shape corresponding to the shape of the desired turbine shroud segment 20 is produced. The mold may have a flow restrictor forming feature as well as a groove forming feature. In this way, the flow restrictor 40 and associated groove 38 can be both conveniently formed at the MIM stage. It is noted that the mold cavity is larger than that of the desired finished part to account for the shrinkage that will occur during debinding and sintering of the green shroud segment. Pins or the like may be inserted in the mold cavity to create cooling holes in the MIM shroud body.

A MIM feedstock comprising a mixture of metal powder and a binder is injected into the mold to fill the mold cavity. The MIM feedstock may be a mixture of Nickel alloy powder and a wax binder. The metal powder can be selected from among a wide variety of metal powder, including, but not limited to Nickel alloys, Cobalt alloy, equiax single crystal. The binder can be selected from among a wide variety of binders, including, but not limited to waxes, polyolefins such as polyethylenes and polypropylenes, polystyrenes, polyvinyl chloride etc. The maximum operating temperature will influence the choice of metal type selection for the powder. Binder type remains relatively constant.

The MIM feedstock is injected at a low temperature (e.g. at temperatures equal or inferior to 250 degrees Fahrenheit (121 deg. Celsius)) and at low pressure (e.g. at pressures equal or inferior to 100 psi (689 kPa)). It is understood that the injection temperature is function of the composition of the feedstock. Typically, the feedstock is heated to temperatures slightly higher than the melting point of the binder. However, depending of the viscosity of the mixture, the feedstock may be heated to temperatures that could be below or above melting point.

Once the feedstock is injected into the mold, it is allowed to solidify in the mold to form a green compact. After it has cooled down and solidified, the mold details are disassembled and the green shroud segment with its integral flow restrictor 40 is removed from the mold. The term "green" is used herein to generally refer to the state of a formed body made of sinterable powder or particulate material that has not yet been heat treated to the sintered state.

Next, the green shroud segment body is debinded using solvent, thermal furnaces, catalytic process, a combination of these know methods or any other suitable methods. The resulting debinded part (commonly referred to as the "brown" part) is then sintered in a sintering furnace. The sintering temperature of the various metal powders is well-known in the art and can be determined by an artisan familiar with the powder metallurgy concept.

Thereafter, the resulting sintered shroud segment body may be subjected to any appropriate metal conditioning or finishing treatments, such as grinding and/or coating. Cooling passages may be drilled in the MIM shroud body if not already formed therein during molding. This also applies to groove 38 if not formed at the MIM stage.

The above description is meant to be exemplary only, and one skilled in the art will recognize that changes may be made to the embodiments described without departing from the scope of the invention disclosed. For example, a wide variety of material combinations could be used for the MIM shroud body and the integrated flow restrictor. Also, the groove 38 could be replaced by a stepped surface formed in the first lateral side of each shroud segment. For instance, the flow restrictor could be positioned to overly a stepped surface formed on the cold radially outer surface of an adjacent shroud segment. Still other modifications which fall within the scope of the present invention will be apparent to those skilled in the art, in light of a review of this disclosure, and such modifications are intended to fall within the appended claims.

The invention claimed is:

1. A method of manufacturing a turbine shroud segment for a gas turbine engine, the method comprising: forming a shroud segment body with a groove defined in a first lateral side thereof and with a flow restrictor projecting integrally from an opposite second lateral side thereof, the groove being oversized relative to the flow restrictor to provide for a clearance fit between the flow restrictor and the groove of adjacent turbine shroud segments when assembled together in a ring formation, wherein forming comprises structurally configuring the flow restrictor to provide support to the adjacent turbine shroud segments and prevent collapsing at shroud segment sides, wherein forming further comprises forming forward and aft hooks extending from a radially outer surface of a platform having an opposite radially inner hot gas path side surface, the flow restrictor having a generally axially extending portion monolithically projecting from the platform, and wherein forming still further comprises metal injection molding (MIM) the flow restrictor together with the shroud segment body, and then subjecting the shroud segment body with the integrated flow restrictor to debinding and sintering operations, and wherein a ratio of an overlap (L') defined by the flow restrictor and the groove of the adjacent turbine shroud segment at hot operating conditions over a clearance (C') between the flow restrictor and the groove of the adjacent turbine shroud segment at the hot operating conditions is about 10.

2. The method defined in claim 1, wherein the groove is obtained by metal injection molding.

3. The method defined in claim 1, wherein the groove and the flow restrictor have complementary tapering profiles.

4. The method defined in claim 1, wherein said groove extends through the platform and at least one of said forward and aft hooks for accommodating the axially and radially extending portions of the flow restrictor of an adjacent shroud segment.

5. The method defined in claim 1, wherein forming the shroud segment includes forming the flow restrictor with a generally radially extending portion monolithically projecting from at least one of the forward and aft hooks.

* * * * *